US005674060A

United States Patent [19]

Buchmüller et al.

[11] Patent Number: 5,674,060

[45] Date of Patent: Oct. 7, 1997

[54] HYDRAULIC INTERNAL GEAR MACHINE HAVING A FLUID PRESSURE BIASED SEALING PLATE

[75] Inventors: Klaus Buchmüller, Malsch; Reinhard Pippes, Bretten-Sprantal, both of Germany

[73] Assignee: Eckerle-Rexroth GmbH & Co. KG, Malsch, Germany

[21] Appl. No.: 586,660

[22] PCT Filed: Jun. 29, 1994

[86] PCT No.: PCT/EP94/02114

§ 371 Date: Dec. 29, 1995

§ 102(e) Date: Dec. 29, 1995

[87] PCT Pub. No.: WO95/02125

PCT Pub. Date: Jan. 19, 1995

[30] Foreign Application Priority Data

Jul. 3, 1993 [DE] Germany ..... 43 22 240.4

[51] Int. Cl.[6] ..... F03C 2/08; F04C 2/10

[52] U.S. Cl. ..... 418/39; 418/132; 418/169

[58] Field of Search ..... 418/39, 132, 166–171

[56] References Cited

U.S. PATENT DOCUMENTS

| | | | |
|---|---|---|---|
| 3,289,599 | 12/1966 | Eckerle et al. | 418/169 |
| 3,303,793 | 2/1967 | Morita | 418/132 |

FOREIGN PATENT DOCUMENTS

| | | | |
|---|---|---|---|
| 46017 | 2/1987 | Austria . | |
| 0188149 | 7/1986 | European Pat. Off. . | |
| 0512514 | 11/1992 | European Pat. Off. . | |
| 1528954 | 7/1970 | Germany . | |
| 2223916 | 11/1973 | Germany | 418/169 |
| 1553015 | 4/1975 | Germany . | |
| 1728085 | 8/1975 | Germany . | |
| 2554960 | 6/1977 | Germany . | |
| 7730698 | 4/1978 | Germany . | |
| 8707256 | 9/1988 | Germany . | |
| 9011541 | 12/1991 | Germany . | |
| 9108238 | 10/1992 | Germany . | |
| 1147178 | 6/1989 | Japan | 418/132 |
| 2051241 | 1/1981 | United Kingdom . | |

*Primary Examiner*—John J. Vrablik
*Attorney, Agent, or Firm*—Martin A. Farber

[57] ABSTRACT

A hydraulic gear machine, in particular an internal gear machine having two gear wheels which mesh with each other in a chamber of a multipart housing, a sealing plate arranged on the side of the two gear wheels axially between them and a housing part, and a pressure field which is present in the housing part on the high-pressure side, is open towards the sealing plate, and is adapted to be acted on by high pressure. The order to provide embodiments of the gear machine which differ in their direction of rotation with the use of many of the same parts, a second pressure field is present in the housing part and the first pressure field is present only on the one side and the second pressure field only on the other side of a center plane which is defined by the axes of rotation of the two gear wheels so that a piece of the housing part is still present between the two pressure fields. Of the two pressure fields of a housing part, only the one pressure field can be acted on by high pressure in the specific counterclockwise or clockwise rotating embodiment. If the same housing part is used in the other embodiment, then the other pressure field is used for pressing the sealing plate against the gear wheels.

16 Claims, 6 Drawing Sheets

FIG. 9
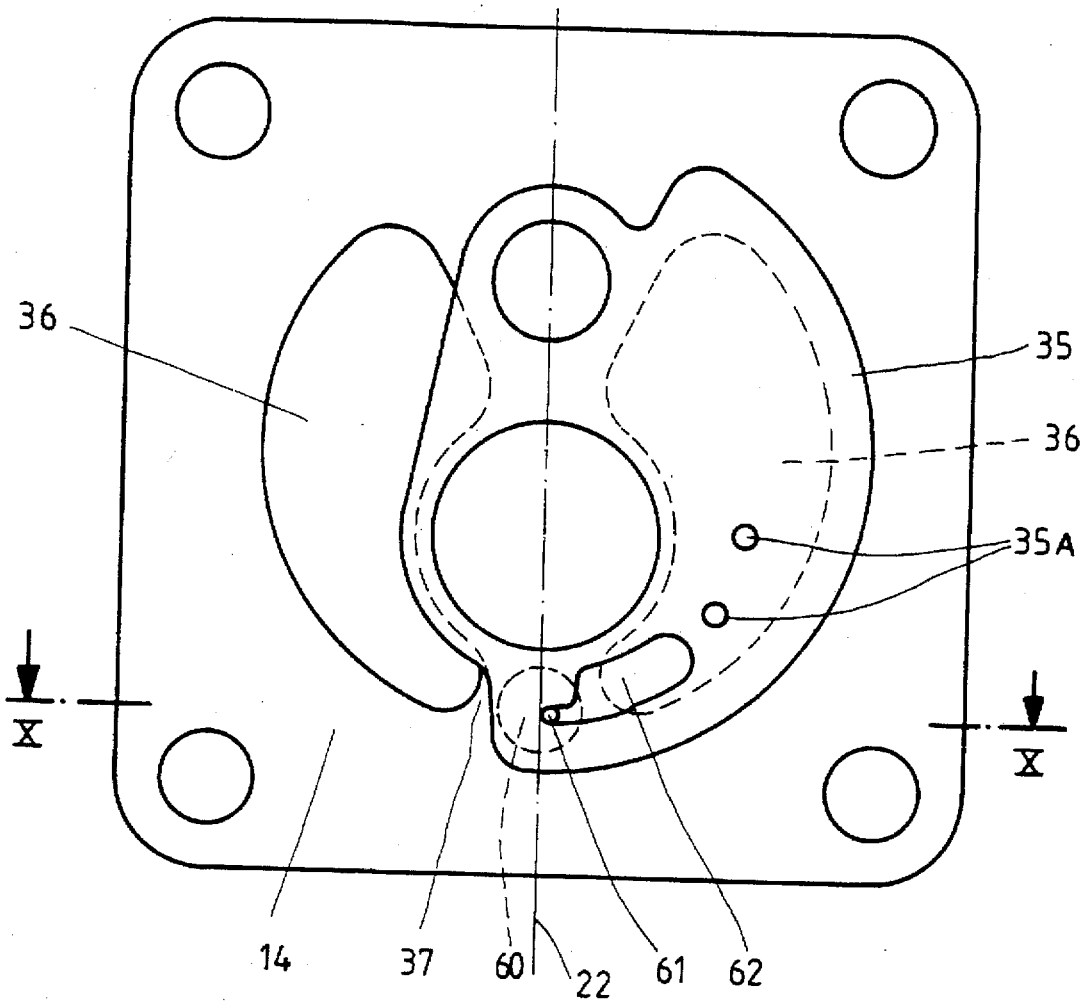
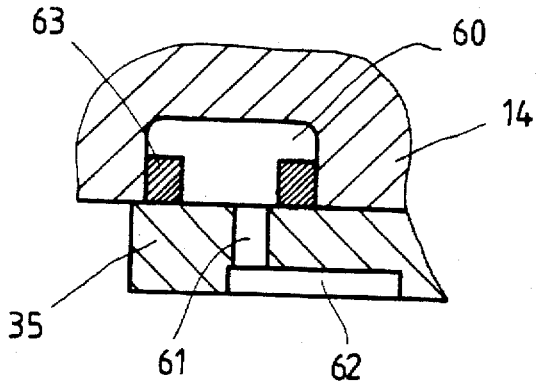
FIG. 10

HYDRAULIC INTERNAL GEAR MACHINE HAVING A FLUID PRESSURE BIASED SEALING PLATE

FIELD AND BACKGROUND OF THE INVENTION

The present invention relates to a hydraulic gear machine, and therefore a gear pump or a gear motor, the gear machine being, in particular, an internal gear machine as described herein.

In known internal gear machines, an internally toothed hollow gear and a smaller externally toothed gear which engages with the hollow gear are contained within a chamber of a multipart housing. In order to avoid leakage losses on the high-pressure side of the machine through an axial slot between the gear wheels and a housing part, a sealing plate is arranged on the side of both gear wheels axially between them and a part of the housing, said plate being pressed against the face side of the gear wheels by a pressure field which is connected with the high pressure side. Internal gear machines are known (Federal Republic of Germany 25 54 960 C2) which have a sealing plate only on one face side of the two gear wheels. In other known internal gear machines, there is a sealing plate on each face side of both gear wheels.

The pressure field which can act with the high-pressure on the high pressure side of the machine is limited in a plane extending perpendicular to the axes of the two gear wheels by a packing which seals off the gap between the sealing plate and the housing part. Depending on whether the packing is inserted into the sealing plate or into the housing part, it is said that the pressure field is located in the sealing plate or in the housing part. It is endeavored to produce a sealing plate in inexpensive fashion by simple stamping and embossing processes. In that case, it is difficult to impart the sealing plate the shape which is necessary for the development of the pressure field within it. It therefore seems more favorable to provide the pressure field in the housing part which is adjacent to the sealing plate and which is customarily produced as a casting and in which the shape desired for the development of the pressure field can be produced already during the casting process.

Generally, the market today requires a clockwise rotating version and a counterclockwise rotating version of a given type of gear machine. It is desirable to be able to produce both embodiments with the greatest possible number of identical parts. In the case of the gear machine having a sealing plate on both sides of the gears and having a pressure field developed in each of the two sealing plates, it is possible to mount the same two sealing plates transposed with respect to each other in the two embodiments, so that the same two sealing plates can be used for both versions. In the event that an axial pressure field is arranged in a housing part which is adjacent to the sealing plate, a different housing part has been used up to now, depending on whether the gear machine was a clockwise or a counterclockwise embodiment.

SUMMARY OF THE INVENTION

The object of the present invention is so to develop a gear machine of the type described herein in such a manner that a housing part which is provided with a pressure field can be used both for a counterclockwise embodiment and for a clockwise embodiment.

According to aspects of the invention a second pressure field is present in the housing part and the first housing part is located only on the one side and the second housing part only on the other side of a center plane which is defined by the axes of rotation of the two gear wheels, so that a piece of the housing part is still present between the two pressure fields. In a concrete embodiment of a gear machine, of course, only one of the two pressure fields is in each case limited by a packing and acted on by the high pressure on the high pressure side of the machine. The second pressure field is recognizable merely by the fact that the housing part is provided also to receive a packing at a place other than that used at the time. Due to the fact that there is still a piece of the housing part present between the two pressure fields, assurance is had that a packing which is intended to limit one of the two pressure fields can be well supported over its entire circumference in a plane extending perpendicular to the axes of the two gear wheels. Depending on whether the housing part is used for a counterclockwise or for a clockwise rotating gear machine, the one or the other pressure field is limited with a packing and used to press the adjacent sealing plate against the gear wheels.

According to a feature of the invention, the second pressure field is arranged symmetrical to the first pressure field with respect to the center plane so that the same conditions are present with respect to the pressure field regardless of the direction of rotation of the machine.

In a known internal gear machine having a single pressure field in a housing part, the limiting line of the pressure field is developed in a region thereof as a circular arc the center point of which lies on the axis of the internally toothed gear wheel developed as a hollow wheel and in a region thereof as a circular arc the center point of which lies on the axis of the externally toothed gear wheel. Furthermore, in the region of the tooth engagement of the two gear wheels, the pressure field extends beyond the center plane defined by the two axes of the gear wheels. In order to at least partially compensate for the loss of surface which has occurred due to the limiting of the pressure field to only one side of the center plane, towards the center plane, adjoining an outer region of the limiting line developed as circular arc, there is a portion of the contour the distance of which from the center point of the circular arc is greater than the radius of the arc. In this way, a complete equalization of surface is thus created in the tooth engagement region, so that the force acting on the sealing plate, assuming the same pressure, corresponds to the force in the known gear machine.

In order to be able, on the one hand, to arrange the pressure fields symmetrically to the center plane and, on the other hand, to be able to act with pressure on the sealing plate in the region of the tooth engagement on both sides of the center plane, there is present, within the engagement region of the two gear wheels, between the first pressure field and the second pressure field, a third pressure field in the housing part, which field extends on both sides of the center plane, this third pressure field being acted on by high pressure together in each case with one of the other two pressure fields.

A development of the hydraulic gear machine which is particularly favorable with respect to a small number of different parts for a counterclockwise and a clockwise embodiment is also provided wherein the housing of the gear machine consists essentially of a middle part, which has a low-pressure connection and a high-pressure connection and closes-off a chamber having two gear wheels which mesh with each other in a direction perpendicular to the axes of the gear wheels, and of two covers both of which are developed symmetrically with respect to a center plane defined by the axes of the two gear wheels. It is then possible to construct a counterclockwise embodiment and a clockwise embodiment of the gear machine using the same parts. In the one embodiment, as compared with the other embodiment, only the middle part is so installed that in each case the other side faces the same cover. Two sealing plates between the covers and the gear wheels are transposed. In order to require only one hole in one cover for the filling-piece pin, the filling-piece pin is mounted in the center plane in one cover, particularly if an axial pressure field is not present in a housing part but in a sealing plate.

For a good sealing of the pressure field with respect to the axial slot between a sealing plate and the adjacent housing part, it is advantageous if an elastomer packing which limits the pressure field dependably retain its position on the edge of the pressure field. This includes it not wandering outward into the axial slot but also not arching inward. From Federal Republic of Germany OS 16 53 837 an internal gear machine is known in which, by means of a support ring consisting of a high-strength plastic or metal, an elastomer packing is to be prevented from traveling into a slot. In order further to increase the assurance against travel of the elastomer packing into an axial slot present between a sealing plate and a housing wall, it is provided that the support ring be open and have two ends which overlap. Thus, the support ring is able to equalize the tolerances of the pressure field on the outer circumference as well as the tolerances of the support ring itself and to apply itself, without radial slot, against a limiting wall of the pressure field. Such a gear machine can therefore be used within a hydraulic system having very high operating pressures. By features of the invention the result is obtained that the operating pressure comes below the packing so that a very good sealing effect and a very good compensation of the force acting from the gear side on a sealing plate are obtained. Due to the individual projections on the inner circumference of the elastomer packing, the latter is still supported on the inner wall of the groove receiving it even if the groove is made wider than the packing itself and therefore can be produced very economically. In case the groove is produced by a machining process, a chip-removing tool having a diameter corresponding to the larger width of the groove can namely be used, which permits a higher in-feed speed. Furthermore, such wide grooves can be easily produced other than by machining, for instance, by pressure casting.

As already indicated, it is favorable for a sealing and compensation effect if the operating pressure arrives below the packing and if in this way the elastomer packing is pressed with a force dependent on the amount of the operating pressure against the sealing plate or the housing part adjacent to the sealing plate. On the other hand, it is favorable for a reliable positioning of the elastomer packing, for it to rest in axial direction both on the sealing plate and on the housing wall.

BRIEF DESCRIPTION OF THE DRAWINGS

With the above and other advantages in view, the present invention will become more clearly understood in connection with the detailed description of preferred embodiments, when considered with the accompanying drawings, of which:

FIG. 9 shows the second embodiment in an axial view, from the gear wheels, on a sealing plate and a cover part; and FIG. 10 is a section along the line X—X of FIG. 9.

DETAILED DESCRIPTION OF THE PREFERRED EMBODIMENTS

Figure 1:
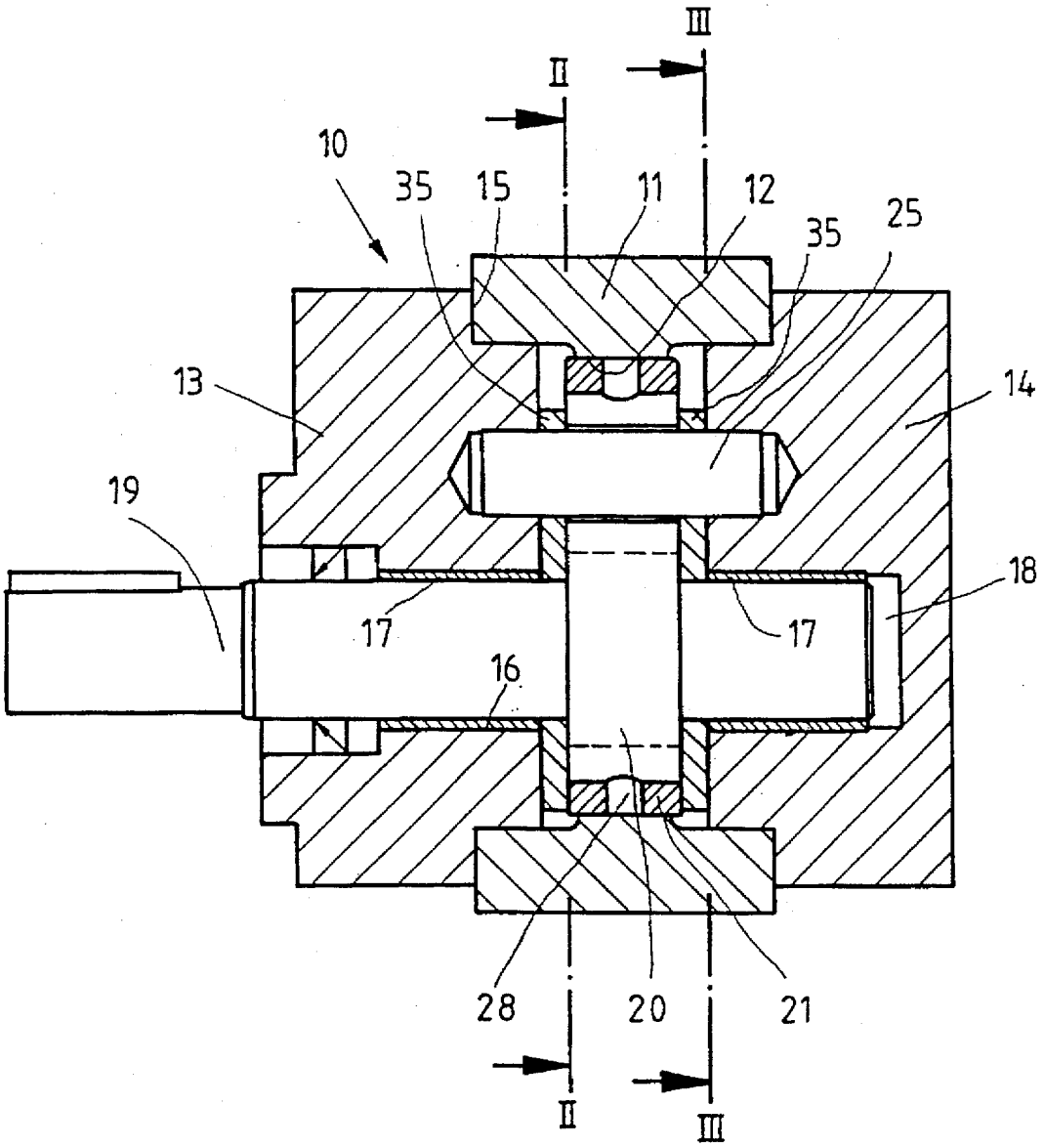
FIG. 1 is a sectional view of a first embodiment through the plane defined by the two axes of the gear wheels.
Figure 2:
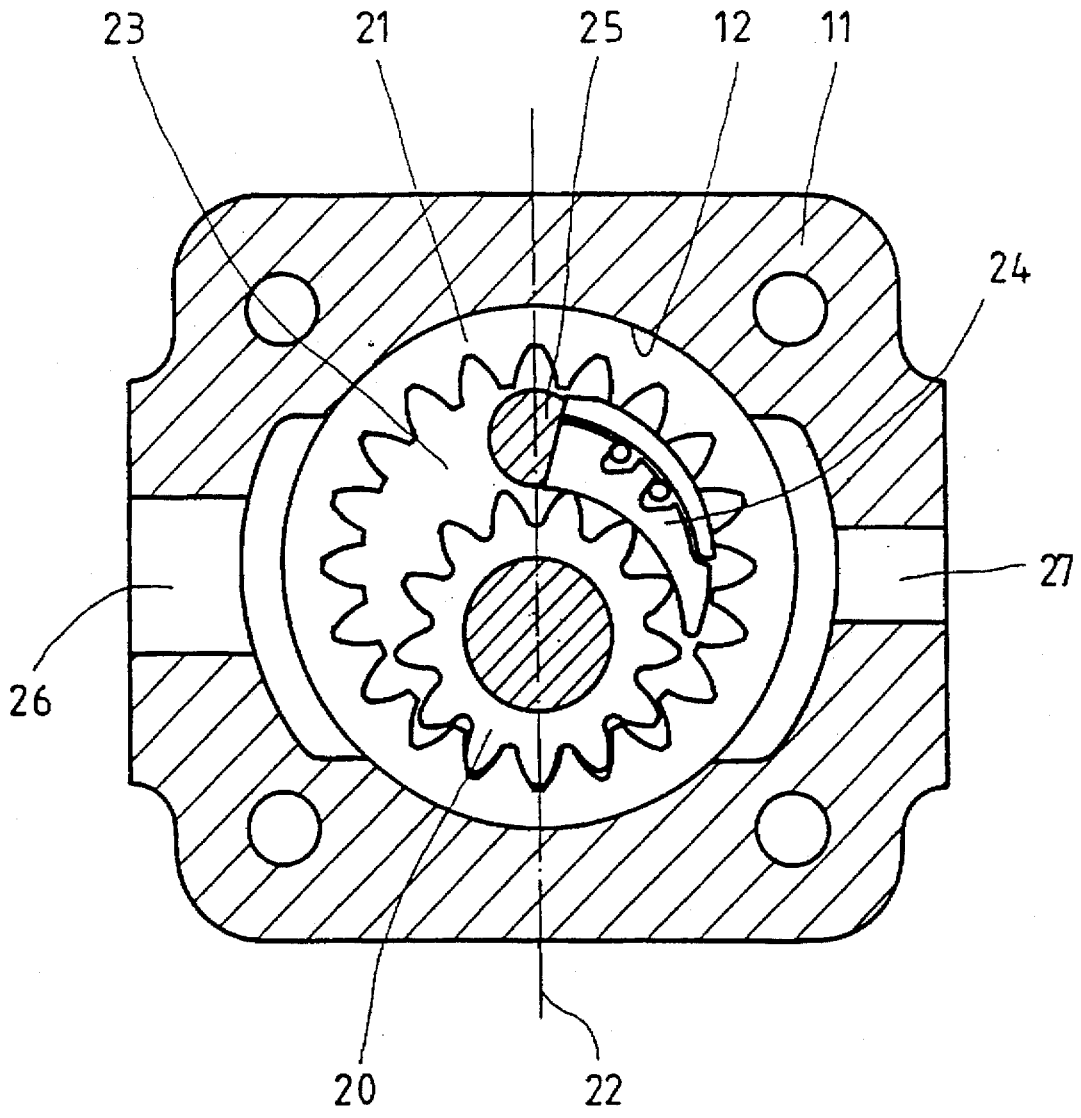
FIG. 2 is a cross section along the line II—II of FIG. 1.

The internal gear pump shown in FIGS. 1 and 2 has a housing 10 which is formed of an annular middle part 11 which radially encloses a pump chamber 12, a first cover part 13, and a second cover part 14. The two cover parts 13 and 14 limit the pump chamber 12 in axial direction. The middle part 11 grips around the two cover parts 13 and 14 in the region in each case of an outer milling 15. The cover part 13 has a continuous bore 16 into which a plain bearing 17 is pressed. With the bore 16 there is aligned a blind hole 18 in the cover part 14, into which hole a plain bearing 17 is also pressed. In the two plain bearings 17 a drive shaft 19 of the pump is supported. An externally toothed pinion 20 is fastened within the pump chamber 12 on the drive shaft 19 or is made in one piece with it. The pinion is located within an internally toothed hollow gear 21 the axis of which is eccentric to the axis of the pinion 20 and which is mounted on its outer circumference in the middle part 11 of the housing 10. In the region on both sides of a center plane 22 which is defined by the two axes of the pinion 20 and the hollow gear 21, the two gears mesh with each other, a crescent-shaped free space 23 being furthermore present between them.

This free space 23 is filled up approximately one half by a bipartite filling piece 24 which lies against the teeth of the pinion 20 and of the hollow gear 21 and rests against a flat on a filling-piece pin 25. The latter passes through the free space 23 in the center plane 22 and is rotatably supported in two blind holes, aligned with each other, in the cover parts 13 and 14 on both sides of the pump chamber 12. The axial length of the filling piece 24 agrees with the axial length of the two gears 20 and 21.

At diametrically opposite places, a suction channel 26 and a pressure channel 27 debouch into the pump chamber 12, the diameter of the suction channel 26 being larger than the diameter of the pressure channel 27. The hollow gear 21 has holes 28 which extend radially from the inside to the outside in the tooth gaps, through which holes a hydraulic fluid can pass from the suction channel 26 into the free space 23 and from there into the pressure channel 27.

The pump of FIGS. 1 and 2 is so constructed that the pinion 20 must, in operation, be driven in clockwise direction as viewed in FIG. 2. The hollow gear 21 then also turns in clockwise direction. Hydraulic fluid present in the tooth gaps travels, together with the tooth gaps, along the filling piece 24 and passes into the tooth-engagement region of the two gear wheels. There, the hydraulic fluid is forced through the holes 28 in the hollow gear 21 into the pressure channel 27. At the same time, hydraulic fluid is drawn through other holes 28 out of the suction channel 26 into the free space 23.

Figure 3:
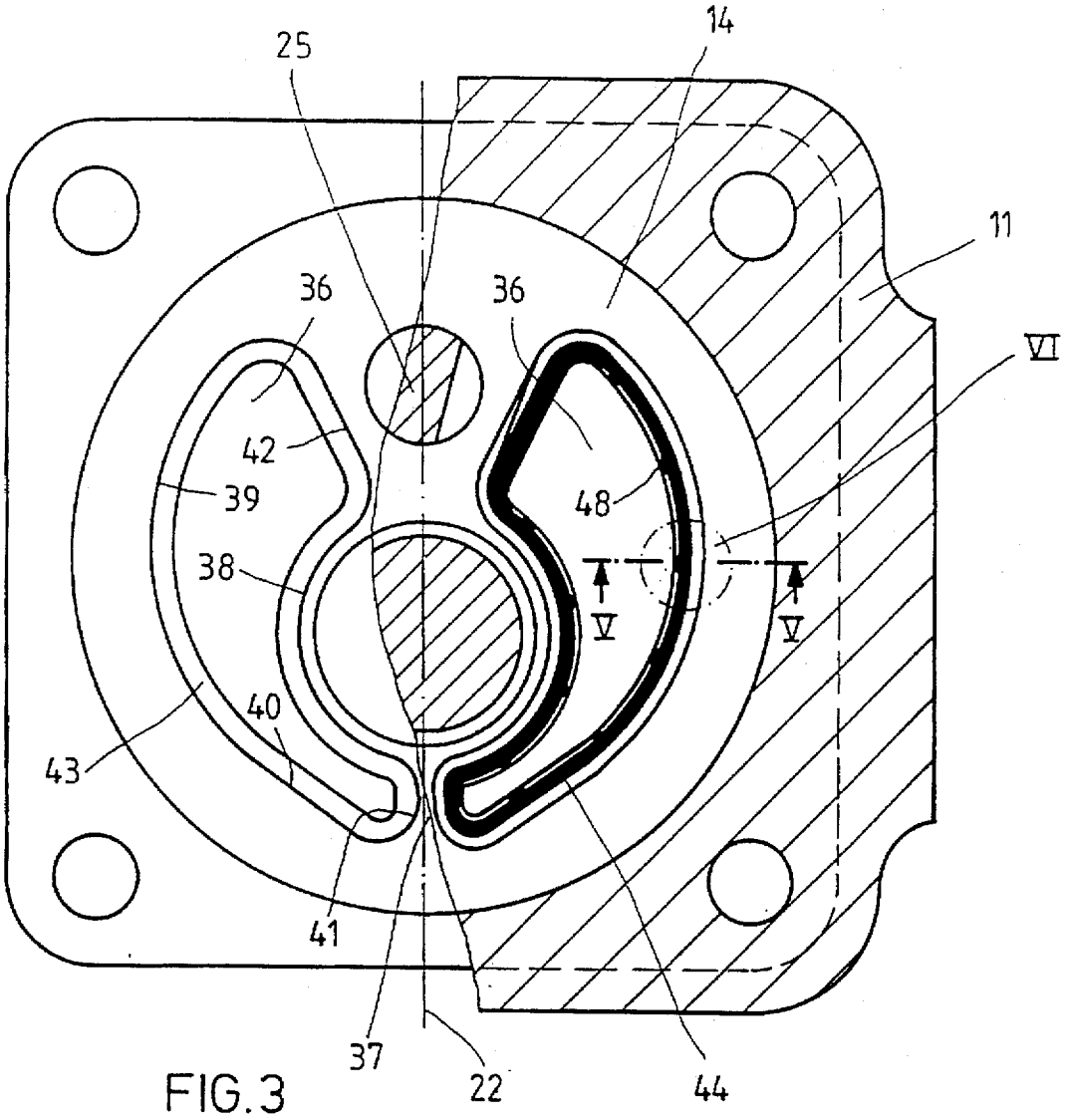
FIG. 3 is a cross section along the line III—III of FIG. 1, a cover part of the housing being shown partially in plan view.

For a high efficiency of the pump, a good axial sealing of the high-pressure side of the pump is necessary, which side can be limited by a region of the pump chamber 12 within which the filling piece 24 is located and within which, adjoining the filling piece, the two gear wheels gradually engage further and further into each other. For a good seal, a sealing plate 35 is arranged between the gear wheels 20 and 21 and each cover part 13 or 14, the plate being pressed axially against the gears 20 and 21 by a pressure field 36 present between it and the corresponding cover part 13 or 14. Each sealing plate 35 closely surrounds the shaft 19 and the filling-piece pin 25 and is thereby secured in its position in a plane perpendicular to the axis of the drive shaft 19. A pressure field 36 is formed by a recess in the cover part 13 and 14. As can be noted further from FIG. 3, it has a half-crescent shape and extends approximately from the foot of the filling piece 24 on the filling-piece pin 25 to close to the center plane 22. It is essential now that in each cover part 13 and 14, on both sides of the center plane 22, there is a recess 36, the two recesses 36 of each cover part being developed as mirror images of each other with respect to the center plane 22. Both terminate at a distance from the center plane 22, so that in their region a piece 37 of the corresponding cover part is still present between the two recesses 36. The outer contour of a recess 36 is formed essentially by four sections, a first section 38 being a circular arc the center point of which lies on the axis of the pinion 20. A second section 39 is also a circular arc, the center of which, however, lies on the axis of the hollow gear 21. This circular arc passes tangentially to the center plane 22 into a straight line 40 which can be considered the third section. A section 41 connects the section 38 in the region of the center plane 22 with the section 40. A section 42 connects the arcs 38 and 39 at their ends spaced away from each other, the section 42 being also in part a straight line.

Figure 4:
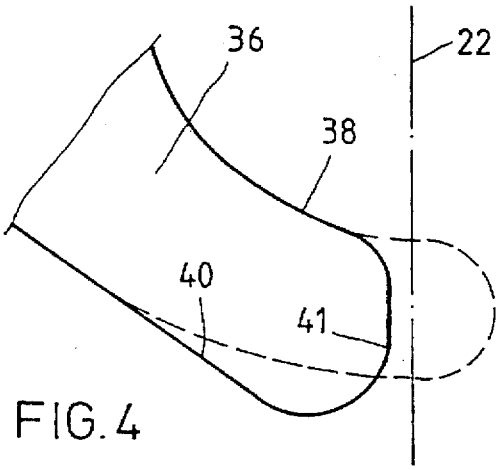
FIG. 4 shows, by way of comparison, a pressure field according to FIG. 3, with a traditional pressure field.
Figure 5:
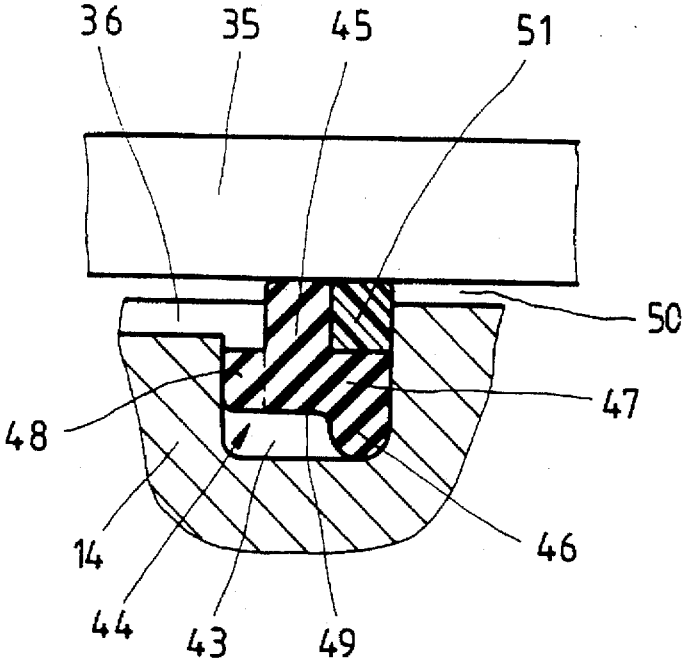
FIG. 5 is a partial section along the line V—V of FIG. 3.
Figure 6:
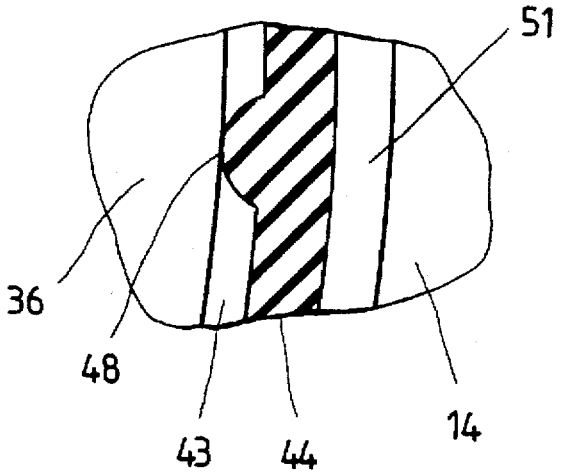
FIG. 6 is an enlarged view of the portion VI in FIG. 3.
Figure 7:
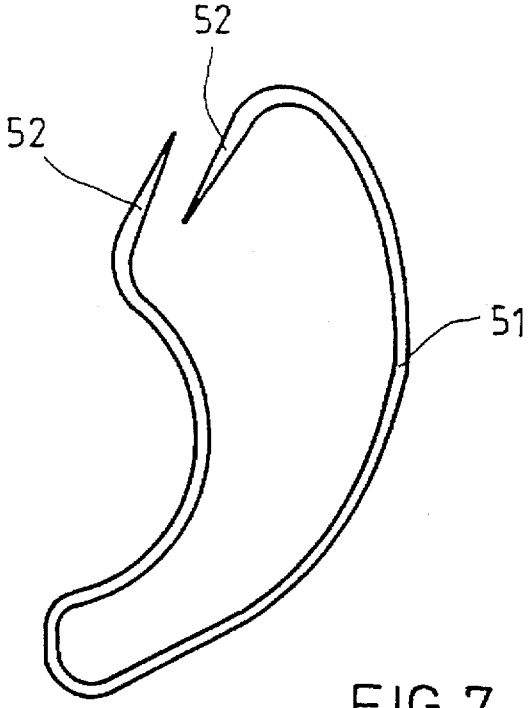
FIG. 7 shows in unmounted condition a support ring for an elastomer packing surrounding a pressure field.

In FIG. 4, alongside the center plane 22 and a portion of a recess 36, the outer contour of a pressure field of a known internal gear pump is indicated by a dashed line. It can be seen that this pressure field extends beyond the center plane 22, while a pressure field of an internal gear pump in accordance with the invention is limited to one side of the center plane and maintains a distance from it in the region of the tooth engagement. In the case of the known pressure field, the circular arc 39 is continued up to the center plane 22. By the enlargement of the radial extent of a pressure field of an internal gear pump in accordance with the invention in the region of the section 40, the reduction of the pressure field in the region of the center plane 22 is approximately compensated for. For the action of the pressure there is thus available in the region of the center plane 22 substantially the same area as in the case of a known internal gear machine, so that a sealing plate 35 is pressed there against the gears also with approximately the same force, assuming the same high pressure.

The two cover parts 13 and 14 of the internal gear pumps shown are developed symmetrically with respect to the center plane 22 not only with regard to the recesses 36 but in their entirety. They can therefore be used both for a pump driven with counterclockwise rotation and a pump driven with clockwise rotation. As a whole, the two embodiments of a pump can be constructed with the same parts. The center plane 22, together with the two sealing plates 35 and the filling piece 24, is merely assembled to the cover parts 13 and 14 turned 180 degrees around an axis passing through the two axes of the gears 20 and 21 and lying in the center plane 22.

Furthermore, in the one embodiment, the one recess 36 and in the other embodiment the other recess 36 of a cover part are sealed off by a sealing arrangement from an axial slot between the corresponding sealing plate 35 and the corresponding cover part 13 or 14. In the embodiment of FIGS. 1 to 7, a groove 43 which has the same depth and width over its entire extent is present in order to receive the sealing arrangement at the edge of each recess 36. Into the groove 43 there is inserted an elastomer packing 44, which, as can be noted from FIG. 5, has a Z-shaped profile in cross section with two end profiled sections 45 and 46 and a middle profiled section 47. The two end profiled sections 45 and 46 are perpendicular to the sealing plate 35, the profiled section 46, which is present on the outer wall of the groove 43, resting axially on the bottom of the groove 43 and the further inward profiled section 45 resting axially against the sealing plate 35. The end profiled section 46 and the middle profiled section 47 of the elastomer packing 44 are entirely within the groove 43. Within the latter, the elastomer packing 44 has individual nubs 48 semicircular in axial view which are spaced from each other and protrude from the inner circumference of the middle profiled section 47 and support the elastomer packing 44 on the inner wall of the groove 43. The nubs 48 are at the same distance from the bottom of the groove 43 as the middle profiled section 47 radially inward of the profiled section 46. The hubs 48 are therefore not directly connected to the profiled section 46, so that a continuously surrounding pressure surface 44 is present on the elastomer packing 44 radially inward of said section. From the high-pressure side of the pump, hydraulic fluid flowing through holes 35A in a sealing plate 35 into a recess 36 can thus pass between the hubs 48 on the rear of the elastomer packing 44 and act with pressure on the packing in the region of the pressure surface 49 so that the elastomer packing 44 is pressed against the sealing plate 35 with a pressure which differs depending on the height of the pressure on the high-pressure side of the pump. On the other hand, the elastomer packing rests radially inward and outward in the groove 43, so that packing reliably retains its position.

In order that the elastomer packing 44 does not travel into the axial slot 50, extending from a pressure field 36, between a sealing plate 35 and a cover part 13 and 14, a support ring 51 of plastic is provided which has a rectangular cross section and is arranged in a region radially outside the first end-profiled section 45 and axially between the middle profiled section 47 of the elastomer packing 44 and the sealing plate 35. As can be clearly noted from FIG. 7, the support ring 51 is a so-called open support ring having two ends 52 which overlap in a plane parallel to the sealing plate 35 in the straight region of the section 42 of the outer contour of a recess 36 relatively far. Overlapping in a plane parallel to the sealing plate 35 in this connection means that upon advance in such plane one passes over both ends 52. Between the two ends therefore, there is no separation joint visible from the inside of a pressure field 36, extending along the support ring. The support ring is, of course, adapted to the outer contour of a recess 36 so that the two overlapping ends 52 are present also in the region of a straight section of the support ring 51. Tolerances in the outer circumference of a pressure field as well as tolerances of the support ring itself can be counteracted by it because of its open shape so that it can apply itself radially without gap against the wall of a cover part 13 or 14.

In the embodiment of FIGS. 1 to 7, two mirror-image elastomer packings 44 are required, one of which is to be inserted into the cover part 13 and the other into the cover part 14. In the case of a pump driven with counterclockwise rotation, the arrangement between cover parts and elastomer packing is precisely the opposite as in the case of a pump driven with clockwise rotation.

Figure 8:
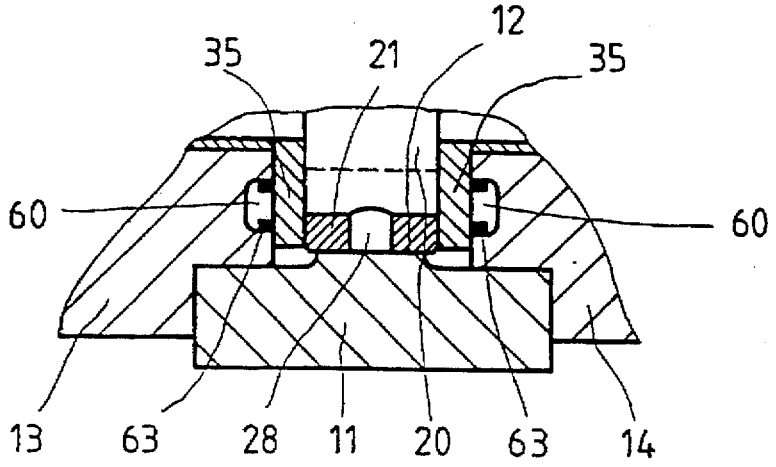
FIG. 8 is a partial section through a second embodiment lying in a sectional plane corresponding to the sectional plane of FIG. 1.

The embodiment in accordance in accordance with FIGS. 8 to 10 has fundamentally the same construction as the embodiment in accordance with FIGS. 1 to 7. Therefore, in the sectional view of FIG. 8, which corresponds to the sectional view of FIG. 1, only a small part of the pump is shown. It is clear from FIG. 9 that, also in this embodiment, there are present in the cover parts 13 and 14, of which the cover part 14 is shown in FIG. 9, two recesses which are symmetrical to each other with respect to the center plane 22. However, the two recesses 36 are, in the region of the tooth engagement of the two gears 20 and 21, at a greater distance from the center plane 22 than the two recesses 36 of the embodiment shown in FIGS. 1 to 7. As a result, the piece 37 is wider. To be sure, each cover part 13 or 14 now has, within the region of the part 37 and at a distance from the recesses 36, a circular recess 60 which is symmetrical on both sides of the center plane 22. This recess is connected with the high-pressure side of the pump via an axial bore-hole 61 which is present in the sealing plate 35 adjacent to the corresponding cover part, debouches into the recess 60, and extends from a recess 62 on the side surface of the sealing plate 35 facing the gears, it being connected with the high-pressure side whether the pump is operated with counterclockwise rotation or with clockwise rotation. In the embodiment rotating in opposite direction from FIG. 9, there is namely associated with the cover part 14 the sealing plate 35 which now is adjacent to the cover part 13 (not shown), while the sealing plate 35 shown in FIG. 9 is associated with the cover part 13. The two sealing plates are developed symmetrically to each other with respect to the center plane 22 insofar as they viewed, placed alongside of each other, in the direction towards the same side facing towards or away from the gears.

As can be noted from FIG. 9, a sealing plate 35 covers substantially only the high-pressure side of a pump, while the low-pressure side is kept free, so that no rubbing can take place there between the gears and a sealing plate, which would reduce the efficiency of the pump. In a specific counterclockwise or clockwise embodiment of the pump, there are active in each case the pressure field 60 and the pressure field 36 which is covered by the sealing plate 35 in an axial view of the gears. Only these two pressure fields are sealed off also with an elastomer packing 63 at the axial slot between the sealing plate 35 and the corresponding cover part. In the embodiment of FIGS. 8 to 10, the elastomer packing is a simple rectangular packing the axial dimension of which is less than the depth of a recess 36 or 60 and which thus can be acted on, on its rear side, by the pressure prevailing in the pressure field and be pressed against the sealing plate 35.

We claim:

1. A hydraulic internal gear machine (pump or motor) which is operable only in one direction of rotation and which comprises a housing in which there are a high-pressure connection and a low-pressure connection and which has a middle part, said middle part has the high-pressure connection and the low pressure connection, said middle part closes off a chamber having a hollow gear and a pinion meshing therewith in a direction perpendicular to the axes of the two gears, and, said middle part is formed asymmetrically with respect to a center plane defined by axes of the two gears, and two cover parts, between which the middle part is located, which has a sealing plate arranged axially between the two gears and a cover part and which has in a high-pressure region a pressure field which can be acted on by high pressure, is open toward the sealing plate, and is present in at least one of the two cover parts, wherein:

in the one cover part there is a second pressure field which is connected to the low-pressure side;

the first mentioned pressure field is located only on the one side and the second pressure field only on the other side of the center plane defined by the axes of rotation of the two gears so that pieces of the cover part are still present between the two pressure fields; and the two cover parts are together developed, symmetrically indifferent in direction of rotation with respect to the center plane.

2. A hydraulic internal gear machine according to claim 1, wherein there are two pressure fields in each cover part, and said sealing plate is asymmetric to the center plane and is located between the two gears and each cover part.

3. A hydraulic internal gear machine according to claim 1, wherein a pressure field has as a limiting line in one region a circular arc, the center point of which lies on the axis of the hollow gear; and towards the center plane, in the region of engagement of the two gears, the circular arc is adjoined as a limiting line by a contour section, the distance of which from the center point is greater than the radius of the circular arc.

4. A hydraulic internal gear machine according to claim 3, wherein the contour section is linear and tangentially adjoins the circular arc.

5. A hydraulic internal gear machine according to claim 1, wherein within the region of engagement of the two gears between the first pressure field and the second pressure field there is located within the cover part a third pressure field which extends on both sides of the center plane; and said third pressure field can be acted on by high pressure in each case together with one of the other two pressure fields.

6. A hydraulic internal gear machine according to claim 5, wherein the third pressure field is symmetrical with respect to the center plane.

7. A hydraulic internal gear machine according to claim 5, wherein the third pressure field is circular.

8. A hydraulic internal gear machine according to claim 7, wherein the sealing plate has an opening, particularly a hole, debouching into the third pressure field and a recess in its side surface facing the gears which extends away from the center plane towards the high-pressure side and from which the opening extends.

9. A hydraulic internal gear machine according to claim 1, wherein a pressure field is located within a recess in the cover part.

10. A hydraulic internal gear machine according to claim 1, wherein a filler piece which is located between an internally toothed hollow gear and an externally toothed pinion is supported on a filler-piece pin which is mounted in the center plane in a cover part.

11. A hydraulic internal gear machine according to claim 1, wherein an axial slot extending from high-pressure pressure field between the sealing plate and a cover plate is sealed off by an elastomer packing.

12. A hydraulic internal gear machine according to claim 4, wherein the third pressure field is circular.

13. A hydraulic internal gear machine according to claim 5, wherein the sealing plate has an opening, particularly a hole, debouching into the third pressure field and a recess in its side surface facing the gears which extends away from the center plane towards the high-pressure side and from which the opening extends.

14. A hydraulic internal gear machine according to claim 6, wherein the sealing plate has an opening, particularly a hole, debouching into the third pressure field and a recess in its side surface facing the gears which extends away from the center plane towards the high-pressure side and from which the opening extends.

15. A hydraulic internal gear machine according to claim 12, wherein the sealing plate has an opening, particularly a hole, debouching into the third pressure field and a recess in its side surface facing the gears which extends away from the center plane towards the high-pressure side and from which the opening extends.

16. A hydraulic internal gear machine according to claim 5, wherein a pressure field is located within a recess in the cover part.

* * * * *